US010294540B2

(12) United States Patent
Fuchigami

(10) Patent No.: US 10,294,540 B2
(45) Date of Patent: May 21, 2019

(54) STEEL WIRE FOR SPRING AND METHOD FOR MANUFACTURING SAME

(71) Applicant: HONDA MOTOR CO., LTD., Tokyo (JP)

(72) Inventor: Hirokuni Fuchigami, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 582 days.

(21) Appl. No.: 14/767,996

(22) PCT Filed: Feb. 19, 2014

(86) PCT No.: PCT/JP2014/053837
§ 371 (c)(1),
(2) Date: Aug. 14, 2015

(87) PCT Pub. No.: WO2014/141831
PCT Pub. Date: Sep. 18, 2014

(65) Prior Publication Data

US 2015/0376731 A1 Dec. 31, 2015

(30) Foreign Application Priority Data

Mar. 12, 2013 (JP) ..... 2013-049399

(51) Int. Cl.
*C21D 9/02* (2006.01)
*C21D 1/10* (2006.01)
(Continued)

(52) U.S. Cl.
CPC ..... *C21D 9/02* (2013.01); *C21D 1/10* (2013.01); *C21D 1/18* (2013.01); *C21D 1/25* (2013.01);
(Continued)

(58) Field of Classification Search
CPC . C21D 9/02; C21D 9/525; C21D 1/10; C21D 1/18; C21D 1/25; C21D 6/004;
(Continued)

(56) References Cited

U.S. PATENT DOCUMENTS 4,222,799 A * 9/1980 Hijikata ..... C21D 1/34 148/320
4,336,081 A * 6/1982 Hijikata ..... B01J 4/00 148/568
2014/0008852 A1 1/2014 Suzuki et al.

FOREIGN PATENT DOCUMENTS

JP H02-035022 B2 8/1990
JP H07-091585 B2 10/1995
(Continued)

OTHER PUBLICATIONS

English Machine Translation of JP 2004-315968 A of Suda et al., published Mar. 23, 2004 (Year: 2004).*
(Continued)

*Primary Examiner* — Jessee R Roe
*Assistant Examiner* — Jophy S. Koshy
(74) *Attorney, Agent, or Firm* — Westerman, Hattori, Daniels & Adrian, LLP

(57) ABSTRACT

A steel wire for a spring, in which the sag resistance and the fatigue characteristics are improved by production processes without addition of alloy elements, is provided. The spring has a structure obtained by quenching and tempering and includes a first layer at a surface thereof, a second layer interior to the first layer, and a third layer, which is interior to the second layer and reaches a center of the spring, and the second layer has lower hardness than the first and the third layers.

5 Claims, 1 Drawing Sheet

(51) Int. Cl.

| | |
|---|---|
| ***C21D 1/18*** | (2006.01) |
| ***C22C 38/00*** | (2006.01) |
| ***C22C 38/58*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |
| ***C22C 38/52*** | (2006.01) |
| ***C21D 6/00*** | (2006.01) |
| ***C22C 38/40*** | (2006.01) |
| ***C21D 9/52*** | (2006.01) |
| ***C21D 1/25*** | (2006.01) |

(52) U.S. Cl.
CPC ..... *C21D 6/004* (2013.01); *C21D 9/525* (2013.01); *C22C 38/00* (2013.01); *C22C 38/002* (2013.01); *C22C 38/02* (2013.01); *C22C 38/04* (2013.01); *C22C 38/12* (2013.01); *C22C 38/14* (2013.01); *C22C 38/16* (2013.01); *C22C 38/32* (2013.01); *C22C 38/40* (2013.01); *C22C 38/52* (2013.01); *C22C 38/58* (2013.01); *C21D 2251/02* (2013.01)

(58) Field of Classification Search
CPC ... C21D 2251/02; C22C 38/40; C22C 38/002; C22C 38/16; C22C 38/52; C22C 38/32; C22C 38/02; C22C 38/14; C22C 38/12; C22C 38/04; C22C 38/58; C22C 38/00
See application file for complete search history.

(56) References Cited

FOREIGN PATENT DOCUMENTS

| | | | |
|---|---|---|---|
| JP | 2004-315968 | A | 11/2004 |
| JP | 2010-133558 | A | 6/2010 |
| JP | 2012-184463 | A | 9/2012 |

OTHER PUBLICATIONS

International Search Report dated May 20, 2014, issued in counterpart International Application No. PCT/JP2014/053837 (1 page).
Office Action dated May 31, 2016, issued in counterpart Chinese Patent Application No. 201480013237.1, with English translation. (11 pages).
Extended (Supplementary) European Search Report dated Sep. 16, 2016, issued in counterpart Eurpean Patent Application No. 14762227.8. (9 pages).

* cited by examiner

STEEL WIRE FOR SPRING AND METHOD FOR MANUFACTURING SAME

TECHNICAL FIELD

The present invention relates to a steel wire for a spring, in which the sag resistance and the fatigue characteristics are improved, and relates to a production method therefor.

BACKGROUND ART

A steel wire for a spring and a production method therefor are disclosed in, for example, Japanese Examined Patent Publication No. 2-35022. According to the technique proposed in this case, a surface layer part of the steel wire is repeatedly subjected to a cycle of rapid heating and rapid cooling so as to be self-cooled by using the temperature difference between the surface layer part and a center part of the steel wire. As a result, crystal grains of the surface layer part are fined without being cooled forcedly. In addition, the heating cycle is repeated until the temperature at the center part exceeds the A1 transformation point, whereby an entire cross section of the steel wire is made to have a martensite structure.

Another technique is disclosed in Japanese Examined Patent Publication No. 7-91585. In this technique, a steel wire is quenched by heating and rapid cooling in a particular pattern in a heating condition (temperature and cooling rate) so that only the surface side thereof is transformed into quenched martensite. Then, the steel wire is reheated and is warm coiled while being tempered, whereby compressive residual stress is generated in the surface due to transformation strain of the martensite of the surface layer.

Regarding reduction in the dimensions and in the weight of suspension springs, high design stress is required, and spring materials should be greatly strengthened in view of sag resistance and durability in responding to the requirement for high design stress. However, when the strength is increased, the delayed fracture sensitivity and the sensitivity to defects such as corrosion pits generated by snow melting material would be increased. Therefore, alloys have been developed by adding large amounts of elements such as Ni, Cu, Cr, Ti, V, etc. thereto so as to decrease the above environmental embrittlement sensitivity. These alloys have low versatility, and the material costs thereof are high, compared with SUP7, SUP12, and the like.

On the other hand, it is publicly known that fining crystal grains is effective as a method for improving the environmental embrittlement resistance. In order to fine crystal grains, a method of rapid heating and rapid cooling is effective, and techniques of using high frequency quenching may be used. Moreover, in order to use springs under high design stress in view of decreasing the weight of the springs, the hardness of the springs should be increased so as to obtain high sag resistance. However, when the hardness is increased, the rate of crack propagation is increased, and the fatigue characteristics are degraded.

DISCLOSURE OF THE INVENTION

Accordingly, an object of the present invention is to provide a steel wire for a spring, in which the sag resistance and the fatigue characteristics are improved by a production procedure without addition of alloy elements, and to provide a production method therefor.

The inventors of the present invention gave thought to performing high frequency quenching on a surface contour portion of a steel wire after high frequency quenching is performed, as a method for improving the environmental embrittlement resistance by a production process. According to this method, crystal grains of a surface layer part of a steel wire are ultrafined, and the hardness of a portion at which a crack would extend is decreased by utilizing HAZ softening phenomenon due to the surface quenching, while the hardness of the surface is increased. As a result, both the sag resistance and the fatigue characteristics can be improved.

The present invention has been completed based on the above concept and provides a steel wire for a spring, and the steel wire has a structure obtained by quenching and tempering and includes a first layer at a surface thereof, a second layer that is interior to the first layer, and a third layer that is interior to the second layer and reaches the center of the steel wire. The second layer has lower hardness than the first layer and the third layer.

If a corrosion pit is generated on a surface of a spring by pitting corrosion, an initial crack may be generated at a bottom portion of the corrosion pit and may propagate, which would lead to rapid fracture. In the present invention, a first layer and a third layer, which are made so as to have a hard tempered structure, have a second layer therebetween, and the second layer is made of a tempered structure that is softer than those of the first and the third layers. According to the present invention described above, even if an initial crack is generated in a corrosion pit formed on the first layer, the crack does not easily propagate in the second layer, which is softer than the first layer. That is, the second layer functions as a barrier layer against the extension of the crack. Accordingly, in the present invention, corrosion fatigue characteristics (environmental embrittlement resistance) are improved.

Moreover, in the present invention, since the first layer and the third layer are made of quenched and tempered structures, the overall steel wire has approximately the same level of average hardness as the hardness of the surface thereof. Therefore, the sag resistance can be improved in the present invention.

The present invention also provides a production method for the steel wire for the spring, and the method includes heating the entirety of the steel wire to a higher temperature than a temperature of austenite transformation point and then quenching the steel wire, heating only a surface layer of the steel wire to a higher temperature than the temperature of the austenite transformation point while quenching a center portion of the steel wire from a lower temperature than a tempering temperature in the subsequent tempering, and tempering the entirety of the steel wire by heating.

Effects of the Invention

According to the present invention, the fatigue characteristics are improved by the second layer, and the sag resistance is improved by the first layer and the third layer, which have high hardness.

MODE FOR CARRYING OUT THE INVENTION

Figure 1:
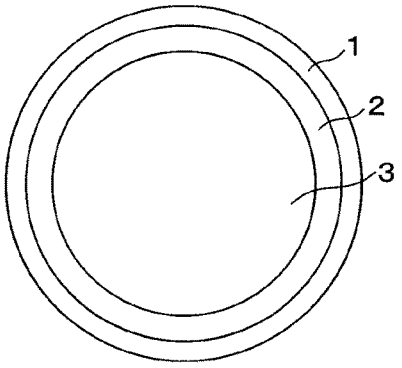
FIG. 1 is an axial cross sectional view showing a steel wire for a spring of an embodiment.

FIG. 1 is an axial cross sectional view showing a steel wire for a spring of an embodiment. The steel wire for the spring includes a third layer 3, a second layer 2, and a first layer 1, in this order, from the center thereof. The first layer 1 desirably has a smaller average grain size than the second layer 2. By making the first layer 1 to have an ultrafine crystal grain structure, the area of the grain boundaries is increased, whereby hydrogen ions entering from corrosion pits into the crystal grains are trapped at large numbers of grain boundaries and thereby have less effect. In addition, segregation of P, S, fine carbides, or the like, at the grain boundaries is reduced, whereby the hydrogen embrittlement resistance are further improved.

Desirable embodiments of the first layer 1 to the third layer 3 are described as follows.

The first layer 1 desirably has a structure made primarily of tempered martensite or troostite and desirably has a prior austenite grain size of No. 12.0 to 14.0 and a hardness of 500 to 700 HV. If the number of the grain size is less than 12.0, the effect of the grain boundaries as hydrogen trap sites may be insufficient. In addition, if the hardness is less than 500 HV, the sag resistance is lower, whereas if the hardness is greater than 700 HV, the corrosion resistance and the hydrogen embrittlement resistance are lower.

The second layer 2 desirably has a structure made primarily of sorbite and desirably has a prior austenite grain size of No. 9.0 to 11.5 and a hardness of 400 to 650 HV.

The third layer 3 desirably has a structure made primarily of tempered martensite or troostite and desirably has a prior austenite grain size of No. 9.0 to 11.5 and a hardness of 500 to 700 HV. If the hardness is less than 500 HV, the tensile strength is low, and the sag resistance is decreased.

The first layer 1 desirably has a thickness of 0.3 to 1.5 mm. If the thickness is less than 0.3 mm, the effect for improving the hydrogen embrittlement resistance by fining the crystal grains may not be sufficiently obtained. On the other hand, if the thickness is greater than 1.5 mm, a distance from a bottom portion of a corrosion pit to the second layer 2 would be great, and cracks would tend to easily propagate, whereby the corrosion resistance would be lower.

The second layer 2 desirably has a thickness of 0.5 to 3.0 mm. If the thickness is less than 0.5 mm, the thickness of the softened layer is small, whereby the effect for improving the crack development lifetime is small. On the other hand, if the thickness is greater than 3.0 mm, the sag resistance is lower.

Next, a production method for a steel wire for a spring of an embodiment will be described with reference to FIG. 2. The production method of the embodiment includes a quenching step, a surface quenching step, and a tempering step. In the quenching step, an entire steel wire is heated to a temperature higher than a temperature of an austenite transformation point, and it is then quenched. In the surface quenching step, only a surface layer of the steel wire is heated to a temperature higher than the austenite transformation point, and a portion under the surface layer has temperature gradient due to thermal transmission from the surface toward a center portion of the steel wire, and thereby, the center portion is quenched from a lower temperature than a tempering temperature in the subsequent step. In the tempering step, the entirety of the steel wire is heated.

In the above heat treatment, a raw material feeding means for winding out a steel wire is arranged at the start of a production line, and a winding device for winding up the steel wire is arranged at the end of the production line. The steel wire is passed through a high frequency heating coil in the quenching step, the surface quenching step, and the tempering step, and is subsequently passed through a cooling jacket. In the cooling jacket, the steel wire is cooled by being brought into contact with a cooling medium.

Figure 2:
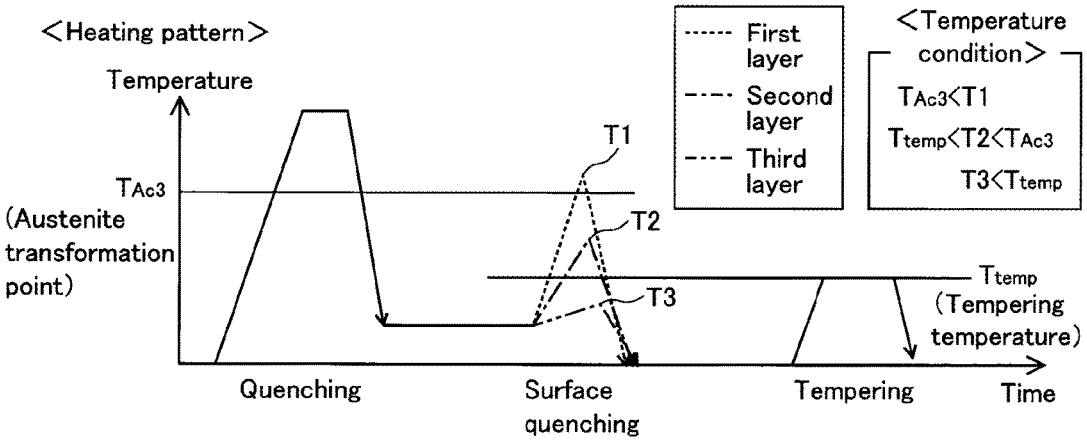
FIG. 2 is a graph showing a heat treatment pattern of a steel wire for a spring of an embodiment.

As shown in FIG. 2, in the quenching step, the entirety of the steel wire is heated to a temperature higher than a temperature of the austenite transformation point ($T_{AC3}$). Then, the steel wire is maintained at this temperature for a predetermined time and is then rapidly cooled, whereby austenite is transformed into martensite.

As shown in FIG. 2, in the surface quenching step, the temperature is gradually lowered from the surface layer to the center portion, and temperatures T1, T2, and T3 are in the range of the temperature conditions shown in FIG. 2. That is, in the surface quenching step, only the first layer, which is the surface layer of the steel wire, is heated to the temperature (T1) that is higher than the temperature of the austenite transformation point ($T_{AC3}$). Specifically, the temperature T1 is 800 to 1000° C. Simultaneously, the third layer at the center portion is heated to the temperature (T3), which is lower than a tempering temperature ($T_{temp}$) in the subsequent step. Thus, at least a part of the third layer is made to be tempered martensite or troostite.

On the other hand, the second layer is heated to the temperature (T2), which is lower than the temperature of the austenite transformation point ($T_{AC3}$), and which is higher than the tempering temperature ($T_{temp}$) in the subsequent step. Since the heating temperature is gradually lowered from the surface layer to the center portion in the surface quenching, such heating treatment can be performed. Therefore, at least a part of the second layer is made to have a structure made primarily of sorbite. It is publicly known that the structure becomes sorbite by tempering at a temperature exceeding 500 to 600° C. and is greatly softened.

When the steel wire that is heated in the above manner is rapidly cooled, the structure of the first layer is transformed from austenite into martensite. In the first layer, the austenite crystal grains are fined by the rapid heating in the quenching step and are further fined by the rapid heating in the surface quenching step.

Next, the steel wire is tempered, and the martensite in the first layer is transformed into, for example, troostite or tempered martensite. The crystal grains thereof are ultrafined by the rapid heating two times. The second layer has a structure that does not change after the surface quenching and that is made primarily of sorbite, which is softer than the first layer. The third layer has a structure made primarily of troostite or tempered martensite and includes crystal grains with sizes similar to those in the second layer. Since the second layer is heated (tempered) at a higher temperature than that for the third layer in the surface quenching step, the second layer is softer than the third layer.

The material of the steel wire is not limited to a steel for springs, and any type of steels that is quenchable can be used. As the quenchable steels, steels containing 0.05 to 0.8 mass % of C may be mentioned. For example, a type of steel consisting of, by mass %, 0.05 to 0.8% of C, 0.1 to 2.5% of Si, 0.1 to 2.5% of Mn, 0.05 to 3.0% of at least one of Cr, Ni, Cu, Mo, Ti, and B, the balance of Fe, and inevitable impurities, may be used.

EXAMPLES

1. Preparation of Samples

The present invention will be described in more detail with reference to Examples hereinafter.

First and Second Practical Examples

Steel wires made of SUP12 with a diameter of 12.6 mm were heated to 960° C. by a high frequency heating coil and were then water cooled (quenching step). Then, the steel wires were heated so that the first layer would be 900° C. and that the third layer would be not more than 470° C., and the steel wires were water cooled immediately after the steel wires reached the target temperatures (surface quenching step). Finally, the steel wires were tempered at 470° C.

First Comparative Example

A sample of a first comparative example was prepared in the same conditions as in the case of the first practical example, except that the surface quenching was not performed.

Second Comparative Example

A sample of a second comparative example was prepared under the same conditions as in the case of the first practical example, except that the material of the steel wire was changed to a material in which 0.02% of Ti and 0.3% of Mo were added to SUP12 and that the surface quenching was not performed.

2. Measurements of Physical Characteristics

The following measurements were performed with respect to the samples of the first and the second practical examples and the samples of the first and the second comparative examples.

Thickness of a layer, grain size, and hardness were measured, and also metallic structure was observed, with respect to the first layer, the second layer, and the third layer of the first and the second practical examples and freely selected portions inside the samples of the first and the second comparative examples. These results are shown in Table 1.

TABLE 1

| | Layer | Thickness (mm) | Grain size | Hardness (HV) | Metallic structure |
|---|---|---|---|---|---|
| First practical example | First layer | 0.8 | No. 13.0 | 602 | Mainly troostite |
| | Second layer | 2.3 | No. 10.0 | 428 | Mainly sorbite |
| | Third layer | Balance | No. 10.5 | 601 | Mainly troostite |
| Second practical example | First layer | 0.75 | No. 12.5 | 615 | Mainly troostite |
| | Second layer | 2.2 | No. 10.5 | 448 | Mainly sorbite |
| | Third layer | Balance | No. 10.5 | 622 | Mainly troostite |
| First comparative example | Uniform structure | — | No. 10.5 | 611 | Mainly troostite |
| Second comparative example | Uniform structure | — | No. 11.5 | 588 | Mainly troostite |

3. Fracture Tests

Corrosion Resistance Test

The samples of the first and the second practical examples and the first and the second comparative examples were cold formed into coil springs and were subjected to annealing, shot peening, and painting under the same conditions. The coil springs had an average coil diameter of 100 mm, active coils of 6.5, and a free height of 355 mm. Holes with diameter of 1 mm were made at constant intervals on the painted surface of the coil springs, and combined cyclic corrosion tests (CCT tests) were performed on these coil springs four times according to the descriptions specified in JASO C6041. Then, the coil springs were subjected to a durability test by vibrating them vertically 150,000 times. The CCT test and the durability test were alternately performed, and duration of durability until the coil springs broke was examined. The durability test was performed under a condition of stress ($\tau$)=588±300 (MPa) or a condition of stress ($\tau$)=588±126 (MPa).

Delayed Fracture Test

The coil springs with no paint were compressed by stress of 1274 MPa and were fixedly held. Then, they were immersed in a solution of 1% of dilute sulfuric acid, and time until breakage was examined.

4. Test Results

The results of the above fracture tests are shown in Table 2. As shown in Table 2, in the corrosion resistance test performed at the amplitude of 300 MPa, the coil spring of the second practical example broke during the CCT test, but still exhibited superior durability compared to the first and the second comparative examples. This is because each of the first and the second practical examples had the soft second layer. Moreover, the first and the second practical examples did not have delayed fracture in a predetermined time. This is because the grain size of the first layer of the first and the second practical examples was No. 13.0 and 12.5, respectively, and was ultrafine, whereby the hydrogen embrittlement characteristics were improved. The second comparative example did not have delayed fracture because its material was made by adding 0.02% of Ti and 0.3% of Mo, which are crystal grain fining elements, to SUP12, and was thereby an alloy with small grain size having superior hydrogen embrittlement resistance.

TABLE 2

| | Results of characteristic tests | | |
|---|---|---|---|
| | Corrosion resistance ($\tau$ = 588 ± 300) | Corrosion resistance ($\tau$ = 588 ± 126) | Delayed fracture $\tau$ = 1274 MPa |
| First practical example | 526656 | 1200000 Did not break | Did not break for 312 hours |
| Second practical example | 450000 (Broke during CCT test) | 1200000 Did not break | Did not break for 312 hours |
| First comparative example | 327800 | 681218 | Broke at 192 hours |
| Second comparative example | 353523 | 900000 (Broke during CCT test) | Did not break for 312 hours |

INDUSTRIAL APPLICABILITY

The present invention can be utilized for springs of various types that are to be assembled in industrial products.

The invention claimed is:

1. A production method for a steel wire for a spring, the steel wire including 0.05 to 0.8 mass % of C, the method comprising:

a first heat cycle step including heating the entirety of the steel wire to a temperature higher than a temperature of austenite transformation point $T_{AC3}$ and then quenching the steel wire;

a second heat cycle step including heating the steel wire, wherein only a first layer at a surface of the steel wire is heated to a temperature T1, a second layer interior to the first layer is heated to a temperature T2, a third layer interior to the second layer and reaching center of the steel wire is heated to a temperature T3, and then quenching the steel wire, wherein T1>T2>T3, T1 is a temperature higher than the temperature of austenite transformation point $T_{AC3}$ and T2 is a temperature lower than the temperature of austenite transformation point $T_{AC3}$; and a third heat cycle step including tempering heating the entirety of the steel wire to a temperature $T_{temp}$, wherein T3<$T_{temp}$<T2;

thereby yielding a steel wire having a structure with the second layer having lower hardness than the first layer and the third layer after the third heat cycle step.

2. The production method for a steel wire for a spring according to claim 1, wherein the first layer has a smaller average grain size than the second layer.

3. The production method for a steel wire for a spring according to claim 1, wherein the temperature $T_{temp}$ is not more than 500° C.

4. The production method for a steel wire for a spring according to claim 1, wherein the steel wire consists of, by mass %, 0.05 to 0.8% of C, 0.1 to 2.5% of Si, 0.1 to 2.5% of Mn, 0.05 to 3.0% of at least one of Cr, Ni, Cu, Mo, Ti, and B, the balance of Fe, and inevitable impurities.

5. The production method for a steel wire for a spring according to claim 1, wherein the quenching in the second heat cycle is performed by water cooling.

* * * * *